US009362676B2

(12) United States Patent
Puhl et al.

(10) Patent No.: US 9,362,676 B2
(45) Date of Patent: Jun. 7, 2016

(54) CONNECTOR WITH CONNECTOR POSITION ASSURANCE DEVICE

(71) Applicant: DELPHI TECHNOLOGIES, INC., Troy, MI (US)

(72) Inventors: Ronald A. Puhl, Poland, OH (US); Peter M. Politsky, Warren, OH (US)

(73) Assignee: Delphi Technologies Inc., Troy, MI (US)

( * ) Notice: Subject to any disclaimer, the term of this patent is extended or adjusted under 35 U.S.C. 154(b) by 0 days.

(21) Appl. No.: 14/476,893

(22) Filed: Sep. 4, 2014

(65) Prior Publication Data

US 2016/0072226 A1 Mar. 10, 2016

(51) Int. Cl.
*H01R 13/627* (2006.01)
*H01R 13/641* (2006.01)

(52) U.S. Cl.
CPC ..... *H01R 13/641* (2013.01); *H01R 13/6272* (2013.01); *H01R 13/6273* (2013.01); *H01R 13/6275* (2013.01)

(58) Field of Classification Search
CPC ..... H01R 13/6272; H01R 13/6275; H01R 13/6273; H01R 13/639; H01R 13/627
USPC ..... 439/352, 353, 357, 347, 157, 345, 627, 439/701, 358
See application file for complete search history.

(56) References Cited

U.S. PATENT DOCUMENTS

| | | | | |
|---|---|---|---|---|
| 5,910,027 | A * | 6/1999 | Wayt | H01R 13/641 439/352 |
| 6,077,101 | A * | 6/2000 | Garretson | H01R 13/627 439/352 |
| 6,435,895 | B1 * | 8/2002 | Fink | H01R 13/6272 439/352 |
| 6,491,542 | B1 | 12/2002 | Zerebilov | |
| 7,399,195 | B2 | 7/2008 | Kim et al. | |
| 7,909,638 | B2 | 3/2011 | Seo et al. | |
| 8,747,146 | B2 | 6/2014 | Brown et al. | |
| 2001/0027058 | A1 * | 10/2001 | Pederson | H01R 13/641 439/595 |
| 2003/0171027 | A1 * | 9/2003 | Shuey | H01R 13/641 439/489 |
| 2013/0260590 | A1 * | 10/2013 | Hitchcock | H01R 13/6272 439/312 |
| 2014/0242823 | A1 * | 8/2014 | Littek | H01R 13/422 439/162 |
| 2015/0147901 | A1 * | 5/2015 | Wu | H01R 13/639 439/357 |

FOREIGN PATENT DOCUMENTS

| | | | |
|---|---|---|---|
| EP | 655807 | A2 | 5/1995 |
| WO | 2010032088 | A1 | 3/2010 |
| WO | 2011069611 | A1 | 6/2011 |
| WO | 2013092310 | A1 | 6/2013 |
| WO | 2014060229 | A1 | 4/2014 |

* cited by examiner

*Primary Examiner* — Abdullah Riyami
*Assistant Examiner* — Harshad Patel
(74) *Attorney, Agent, or Firm* — Robert J. Myers

(57) ABSTRACT

A connector assembly including a first connector having a primary locking lever that is configured to mate with a second connector having a primary striker. The primary locking lever includes a beam extending along a mating axis and a primary latch configured to engage the primary striker. The connector assembly includes a connector position assurance (CPA) device slideably mounted to the first connector. The primary latch blocks movement of the CPA device from an initial position to a final position until the first connector and the second connector are fully mated. The CPA device defines a lateral flange that inhibits movement of a secondary latch of the CPA device under the primary latch that would allow the CPA device to move from the initial position prior to the full mating of the first connector and the second connector.

19 Claims, 5 Drawing Sheets

CONNECTOR WITH CONNECTOR POSITION ASSURANCE DEVICE

TECHNICAL FIELD OF THE INVENTION

The invention generally relates to a connector, such as an electrical wiring connector, particularly a connector having a connector position assurance device.

BACKGROUND OF THE INVENTION

In certain industrial applications, electrical connectors are required to be securely connected to each other. These electrical connectors are typically provided with a primary latch and a primary striker to lock the connector housings to each other. In addition, a connector position assurance (CPA) device is provided to lock the locking members as an additional locking assurance. Before the connector is engaged with a corresponding mating connector, the CPA device is in initial position that allows the primary latch and striker to move relative to each other. When a connector housing of a first connector is connected to a counterpart connector housing of a second connector and the primary latch and striker are engaged to each other, the CPA device may then be moved within the connector housing to a final position to prevent the primary latch and striker from disengaging, so as to secure the locking status of the first and second connectors.

Ideally, the CPA device will remain in the initial position and movement of the CPA device to the final locking position will be inhibited until the two mating connectors are fully mated together. This provides assurance to the operator connecting the first and second connectors that they in a fully mated position. However, as illustrated in FIG. 1, under certain conditions, the CPA device 1 may be pushed from the initial position before the mating connectors are fully mated if the secondary latch 2 of the CPA device 1 can be forced under the primary latch 3. This may cause difficulties in connecting the two connectors correctly. An example of a connector assembly in which this condition can occur may be found in International Publication Number WO 2010/032088, the entire disclosure of which is hereby incorporated by reference herein. Therefore, a CPA device that cannot be moved from the initial position before the two mating connectors are fully mated may still be desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a connector assembly is provided. The connector assembly includes a first connector configured to mate with a second connector along a mating axis, a primary locking lever pivotably mounted to the first connector, a beam defined by the primary locking lever and extending along the mating axis and a primary latch mounted to the beam. The primary latch further defines a secondary striker. The connector assembly further includes a connector position assurance (CPA) device movable from an initial position to a final position only when the first connector and the second connector are mated. The CPA device has a mobile base slideably mounted to the first connector and a CPA lever mounted to the mobile base defining a secondary latch. The secondary latch engages said primary latch to inhibit movement of the CPA device from the initial position to the final position until after the first connector and the second connector are mated. The CPA lever defines a lateral flange that is configured to engage said beam, thereby maintaining engagement of the primary latch with the secondary latch until the first connector and the second connector are mated. The second connector includes a primary striker configured to engage the primary latch so as to lock the first connector and the second connector together when the first connector and the second connector are mated. The secondary latch of the CPA device is configured to engage the secondary striker when the CPA device is in the final position so as to prevent disengagement of the primary latch from the primary striker.

The primary locking lever may have a pair of beams extending from the primary latch along the mating axis and generally parallel to one another. The pair of beams defines a slit there between. The CPA lever may be at least partially disposed within this slit.

The lateral flange may extend laterally on each side of the CPA lever and be configured to engage said pair of beams, thereby maintaining engagement of the primary latch with the secondary latch until the first connector and the second connector are mated.

The lateral flange may be configured to engage the pair of beams, thereby maintaining engagement of the primary latch with the secondary latch until after the first connector and the second connector are mated. The lateral flange may be configured to inhibit a submarining of the CPA lever under the primary latch before the primary latch is engaged with and locked to the primary striker or until the first connector and the second connector are mated.

The lateral flange may be configured to inhibit movement of the CPA lever forward of the primary latch before the primary latch is engaged with and locked to the primary striker.

Vertical movement of the secondary latch may be inhibited by a wall of the first or second electrical connector when the CPA device is in the final position, thereby inhibiting release of the primary latch from the primary striker.

The CPA lever may be more rigid than the primary locking lever, so as to be able to inhibit release of the primary latch from the primary striker without the CPA lever interfacing a wall of the first or the second connector.

In accordance with another embodiment, a connector assembly is provided. The connector assembly includes a first connector and a second connector configured to mate with each other along a mating direction. The first connector has a primary latch and a secondary striker and the second connector has a primary striker configured to engage the primary latch so as to lock the first connector and the second connector when they are mated. The first connector includes a CPA device movable from an initial position to a final position only when the first connector and the second connector are mated. The CPA device includes a mobile base mounted on a housing of the first connector, a CPA lever fixed to the mobile base, and a secondary latch configured to engage, in the final position of the CPA device, the secondary striker so as to prevent disengagement of the primary latch and the primary striker. The connector assembly further includes a lateral flange defined by the CPA lever configured to allow a movement of the CPA device from the initial position to the final position only when the first connector and the second connector are mated.

The primary latch may be mounted to a pair of beams extending along a mating axis generally parallel to one another and defining a slit there between. The CPA lever is at least partially disposed within this slit.

The lateral flange may extend laterally on each side of the CPA lever. The lateral flange may be configured to engage the pair of beams, thereby inhibiting a submarining of the CPA lever under the primary latch before the primary latch is engaged with, and locked to, the primary striker or until the first connector and the second connector are mated. The lateral flange may be configured to inhibit movement of the CPA lever forward of the primary latch before the primary latch is engaged with and locked to the primary striker.

15. Vertical movement of the CPA lever may be inhibited by a wall of the first or the second connector when the CPA device is in the final position, thereby inhibiting release of the primary latch from the primary striker.

16. The secondary latch may be more rigid than the primary latch, so as to be able to inhibit release of the primary latch from the primary striker without the CPA lever interfacing a wall of the first or the second connector.

In accordance with yet another embodiment, a connector assembly is provided. The connector assembly includes a first connector configured to mate with a second connector along a mating axis. The second connector includes a primary striker. The connector assembly further includes a primary locking lever pivotably mounted to the first connector, a beam defined by the primary locking lever and extending along the mating axis and a primary latch configured to engage the primary striker. The primary latch further defines a secondary striker. The connector assembly also includes a CPA device movable from an initial position to a final position. The CPA device has a mobile base slideably mounted to the first connector and a CPA lever mounted to the mobile base defining a secondary latch. The primary latch is in a position to block movement of the CPA device from the initial position to the final position until the first connector and the second connector are fully mated and the primary latch is engaged with the primary striker. The CPA lever defines a lateral flange configured to contact said beam, thereby inhibiting movement of the secondary latch under the primary latch that would allow movement of the CPA device from the initial position prior to the full mating of the first connector and the second connector.

The secondary latch of the CPA device is configured to engage the secondary striker when the CPA device is in the final position so as to prevent disengagement of the primary latch from the primary striker.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
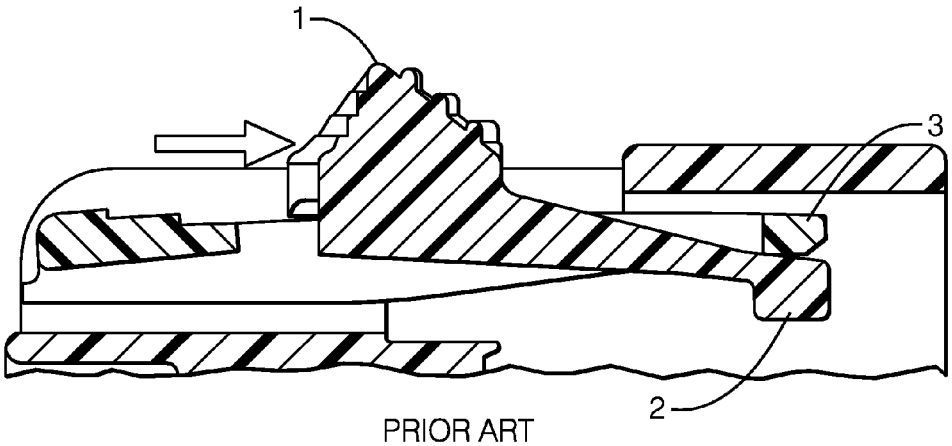
PRIOR ART FIG. 1
FIG. 1 is a cutaway side view of connector assembly having a connector position assurance (CPA) device in an improper location according to the prior art.

The connector assembly described herein includes a primary locking system made up of a primary latch and primary striker that, when engaged, inhibit the first and second connectors of the connector assembly from being inadvertently separated. The connector assembly further includes a connector position assurance (CPA) device that is essentially a secondary locking system. The CPA device is designed so that it can be moved from an initial position to a final position that inhibits disengagement of the primary locking system. The CPA further verifies that the first and second connectors of the connector assembly are fully mated, since it cannot be moved to the final position until they are fully mated. The CPA device described herein includes a feature that prevents the CPA device from being moved to the final position before the first and second connectors are fully mated, thus solving the problem described in the Background of the Invention section of this specification.

In the following description, orientation terms such as "longitudinal" will refer to the mating axis X while "lateral" is understood to refer to an axis perpendicular to the mating axis, which is not necessarily the transverse axis. Furthermore, terms relating to heights such as "top" or "bottom" are to be understood relative to an axis perpendicular to the mating axis X, which is not necessarily the vertical axis. As used herein the terms "front" and "forward" refer to a lateral orientation oriented from the first connector towards the second connector and the terms "back", "rear", "rearward", and "behind" refer to a lateral orientation oriented from the second connector towards the first connector.

A non-limiting example of the connector assembly 10 is shown in FIGS. 2-8. The connector assembly 10 includes a first connector 12 that includes a shroud 14 that defines a cavity 16 within. The first connector 12 is configured to receive a corresponding second connector 18 within the cavity 16 when the first connector 12 is mated to the second connector 18. The connector assembly 10 illustrated here is an electrical connector configured to join electrical wires. The first and second connectors 12, 18 each contain electrical terminals (not shown) attached to electrical wires (not shown) that are designed to interface and connect with corresponding terminals (not shown) in the corresponding connector. While the connector assembly 10 illustrated here is constructed to interconnect a plurality of wire pairs, alternative embodiments of the connector assembly may connect only a single wire pair. Other alternative embodiments of the connector assembly may be used to interconnect other types of conductors, such as fiber optic cables, fluid carrying lines, pneumatic tubing, or a combination of any of these.

The connector assembly 10 includes a primary locking lever 20 that is pivotably mounted to a top surface 22 of the first connector 12. The primary locking lever 20 is elastically hinged to the top surface 22 of the first connector 12. The primary locking lever 20 includes a pair of beams 24 extending along the mating axis X and generally parallel to one another. The pair of beams 24 defines a slit 26 between them.

Figure 4:
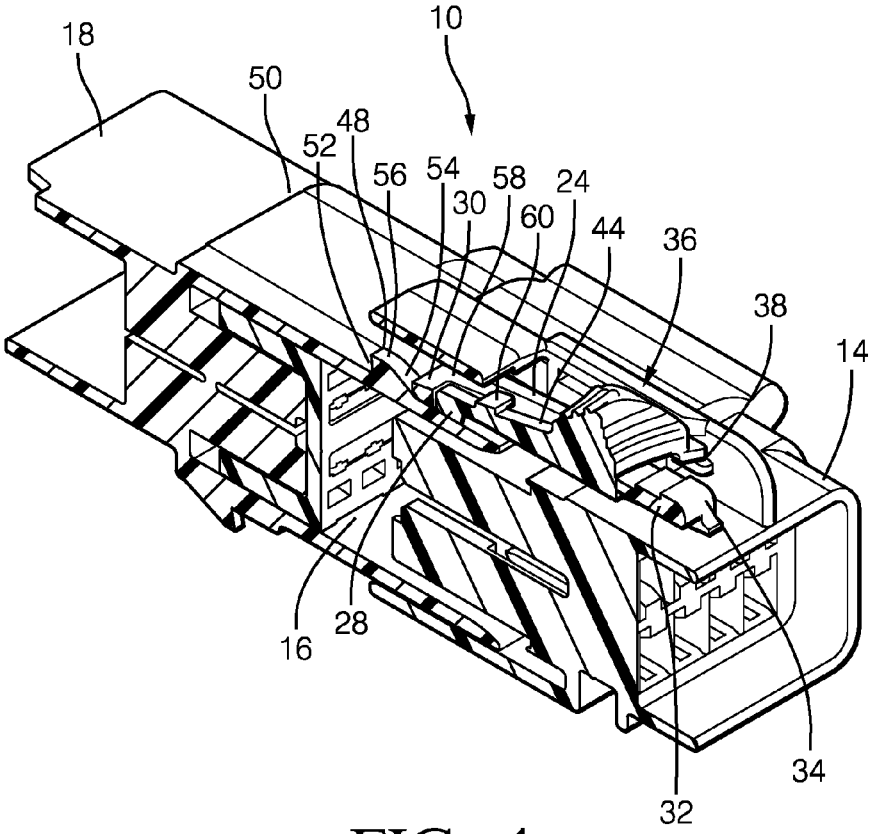
FIG. 4 is a perspective cut-away view of the connector assembly of FIG. 3 in the process of being mated and having the CPA in an initial position according to one embodiment.

As illustrated in FIG. 4, the primary locking lever 20 further includes a primary latch 28 that mounted to the forward portion of the pair of beams 24. The forward edge of the primary latch 28 defines a secondary striker 30. In order to lift up the primary latch 28, the primary locking lever 20 comprises a lifting lever 32 having a front end fixed to the pair of beams 24, and release button 34 on the opposing end of the lifting lever 32. The lifting lever 32 comprises a pivot lug (not shown) intended to cooperate with the top surface 22 of the first connector 12, when the first and second connectors 12, 18 are mated. In this way, the primary latch 28 can only be lifted up when the first and second connectors 12, 18 are mated.

Figure 2:
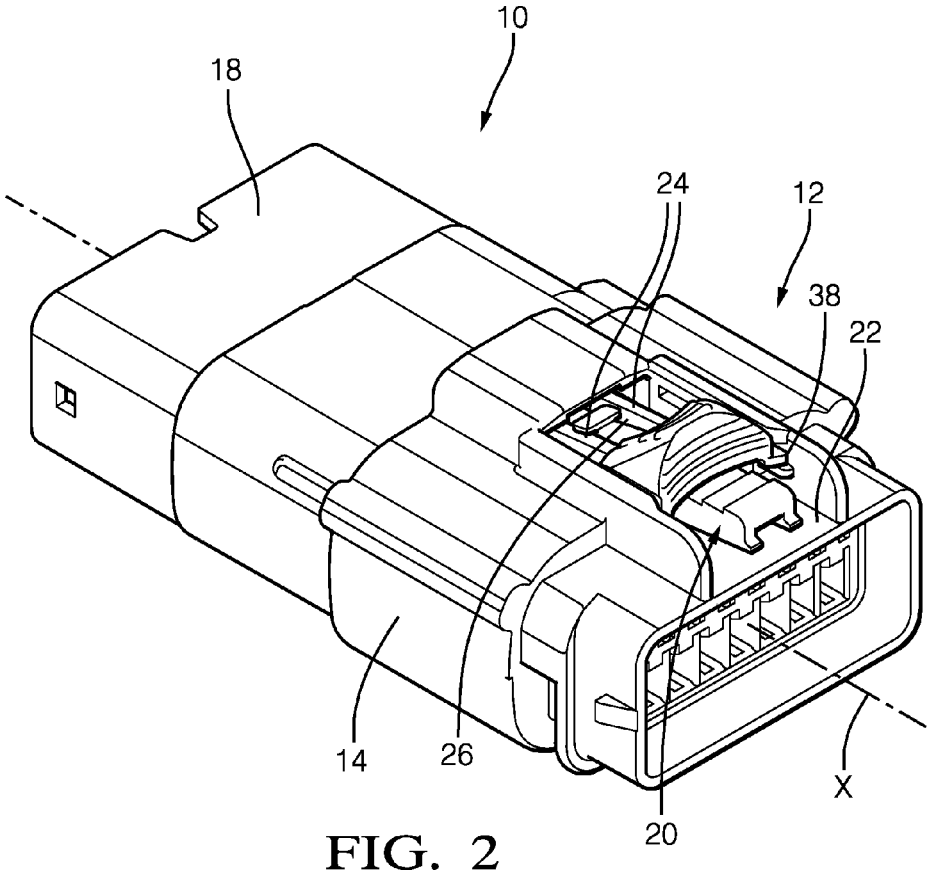
FIG. 2 is an exploded perspective view of a connector and a CPA device according to one embodiment.
Figure 3:
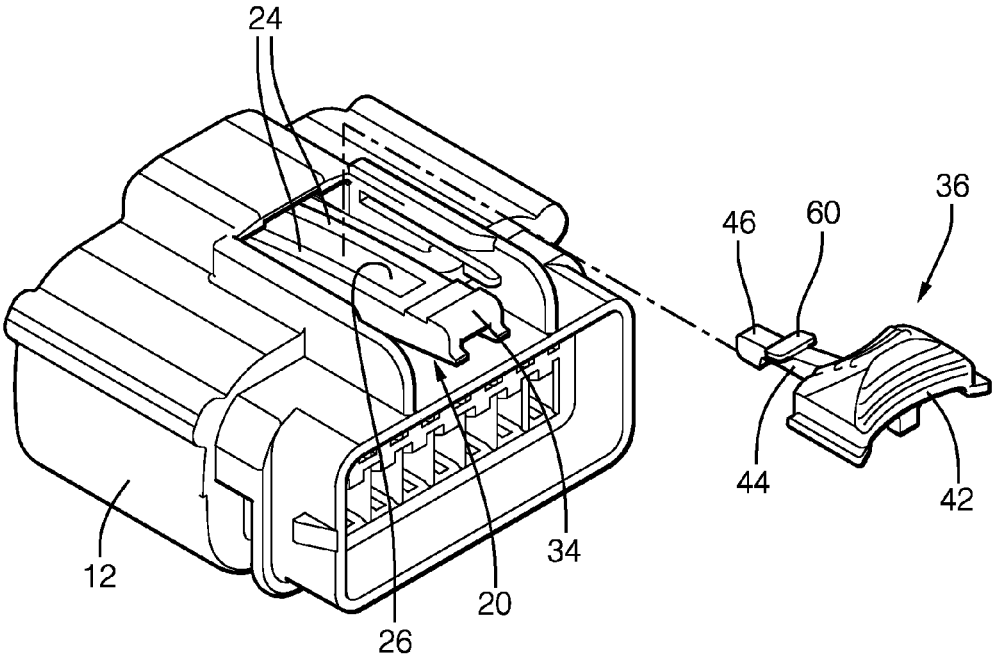
FIG. 3 is a perspective view of a connector assembly in the process of being mated and having the CPA in an initial position according to one embodiment.
Figure 5:
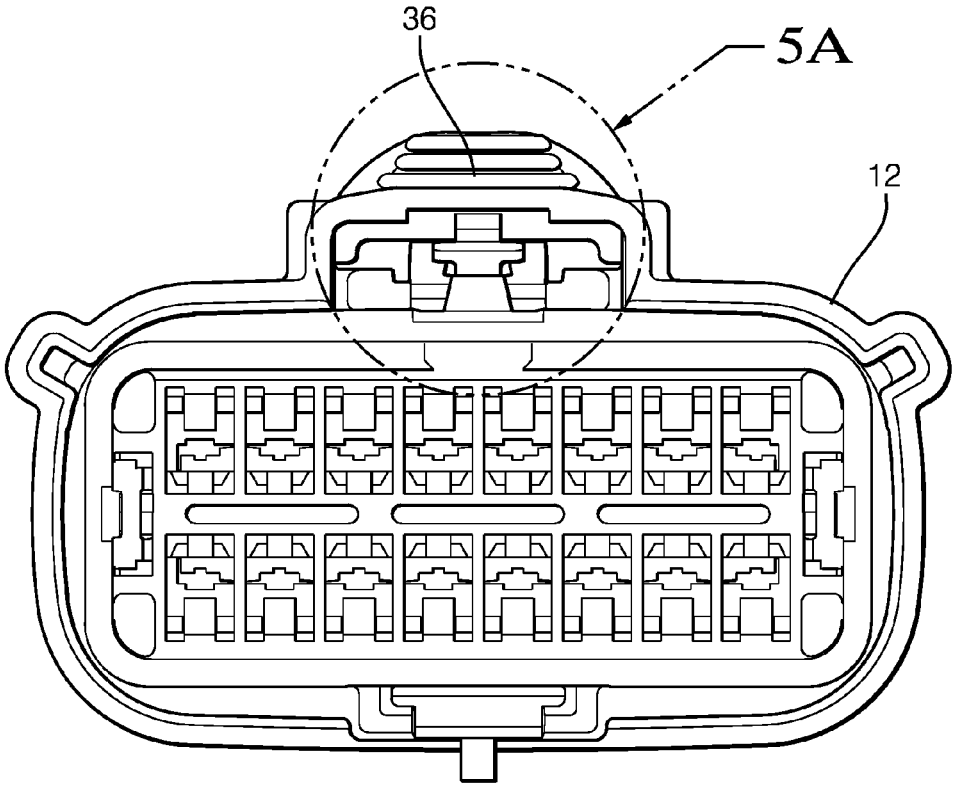
FIG. 5 is an end view of the connector assembly of FIG. 3 in the process of being mated and having the CPA in the initial position including a close-up view of a locking member and the CPA device according to one embodiment.
Figure 5A:
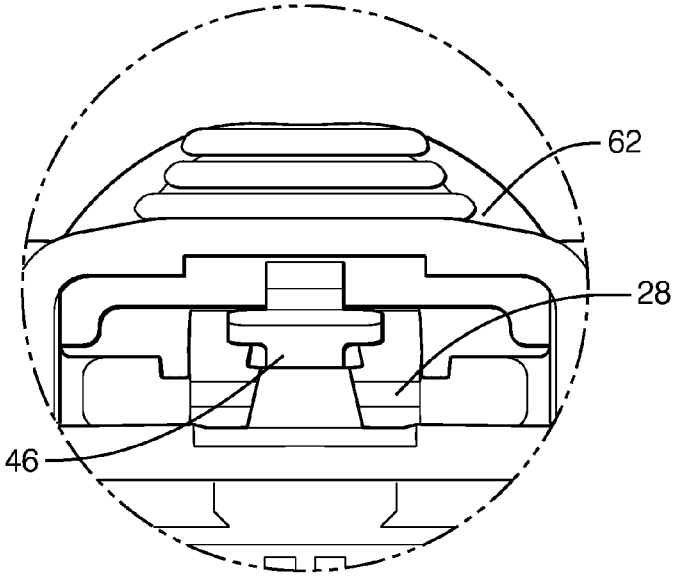
Figure 6:
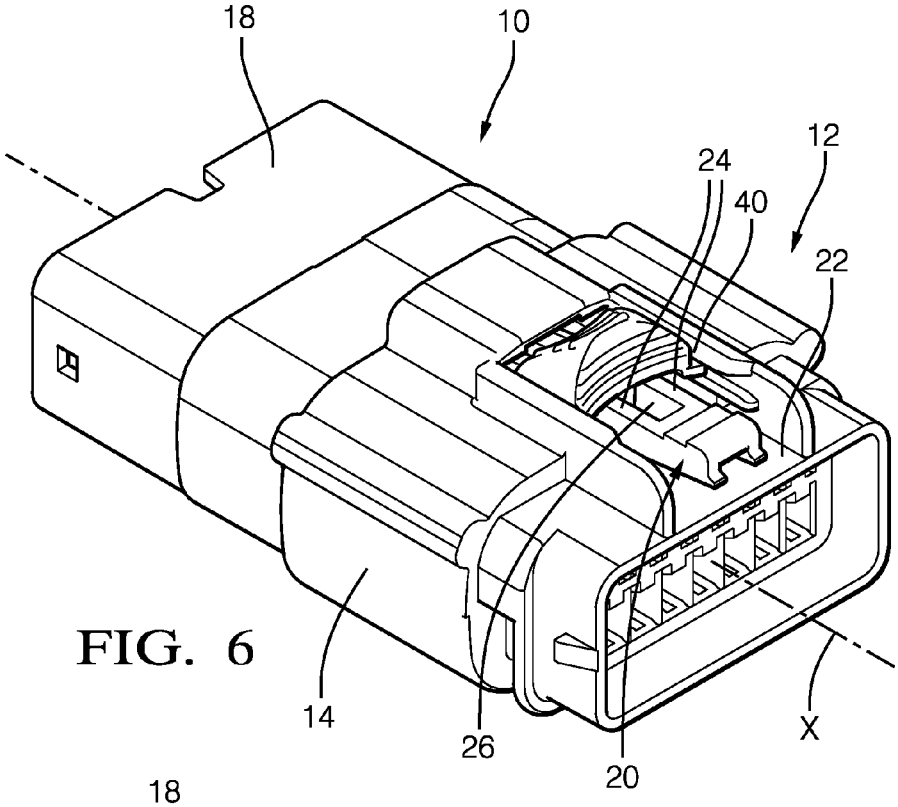
FIG. 6 is a perspective view of the connector assembly of FIG. 3 in a fully mated condition and having the CPA in a final position according to one embodiment.
Figure 7:
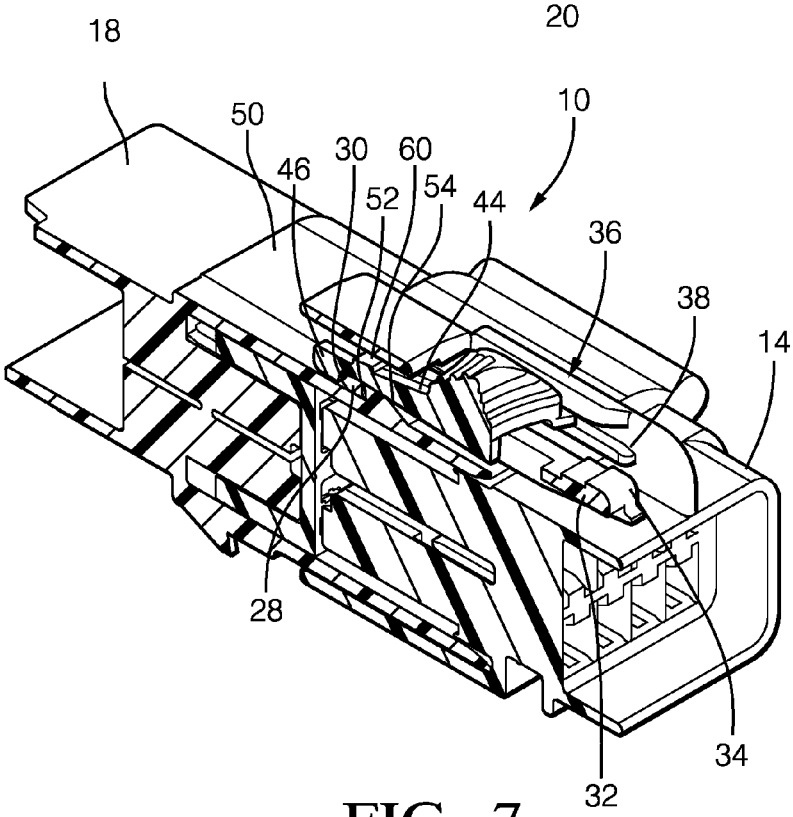
FIG. 7 is a perspective cut-away view of the connector assembly of FIG. 3 in the fully mated condition and having the CPA in a final position according to one embodiment.
Figure 8:
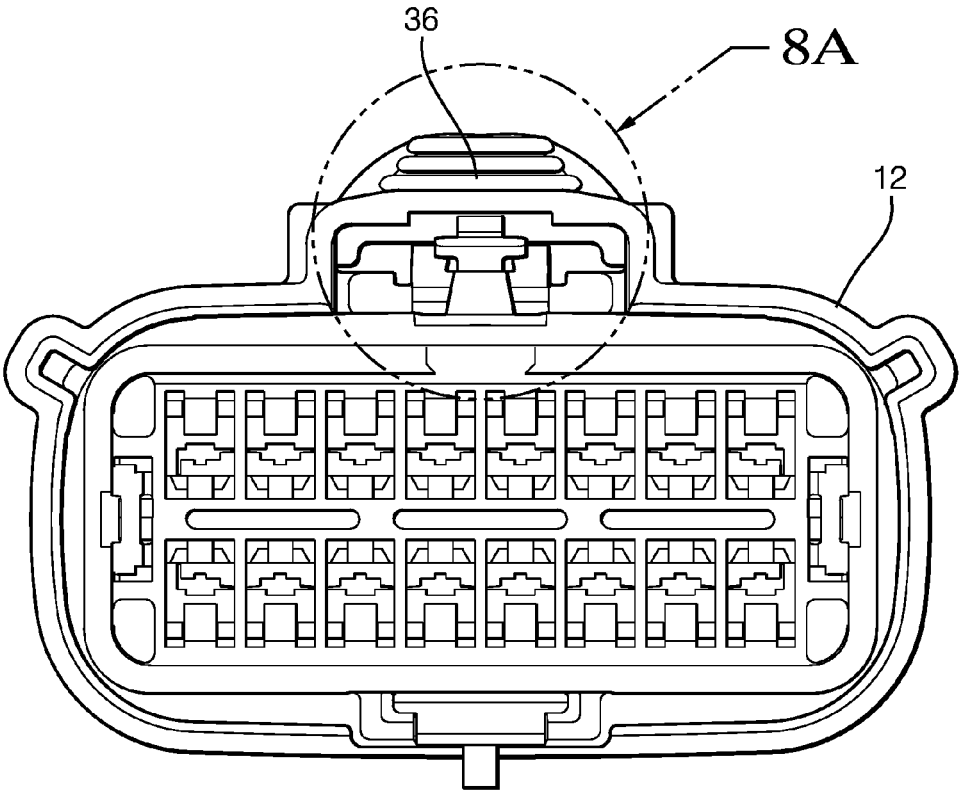
FIG. 8 is an end view of the connector assembly of FIG. 3 in the fully mated condition and having the CPA in a final position including a close-up view of a locking member and the CPA device according to one embodiment.
Figure 8A:
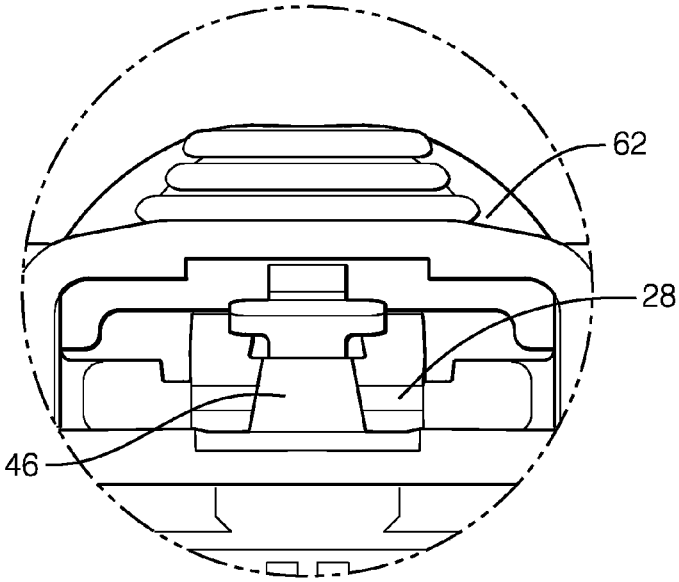

The connector assembly 10 further includes a connector position assurance (CPA) device 36 that is movable from an initial position 38 as shown in FIGS. 2, 4, and 5 to a final position 40 as shown in FIGS. 6-8. As best illustrated in FIG. 3, the CPA device 36 has a mobile base 42 that is slideably mounted to the first connector 12, and a CPA lever 44 attached at one end to the mobile base 42. The CPA lever 44 defines a secondary latch 46 at a free end of the CPA lever 44. The CPA lever 44 may be characterized as a cantilever beam.

Referring again to FIG. 4, the second connector 18 includes a primary striker 48 fixed to the top surface 50 of the second connector 18. The primary striker 48 has a locking rear end 52 that defines a striker surface that engages the primary latch 28 and a sloped front end 54 defining a ramp surface. The primary striker 48 also has a top striker surface 56 between the locking rear end 52 and the sloped front end 54.

The operation of a locking system of the connector assembly 10 will now be described.

When the CPA device 36 is in the initial position 38 as shown in FIGS. 2 and 4, and when the first and second connectors 12, 18 are unmated, the CPA lever 44 is located in the slit 26 between the pair of beams 24. The secondary latch 46 of the CPA lever 44 is blocked by the primary latch 28 of the primary locking lever 20 that is forward of the secondary latch 46 as so that the CPA device 36 cannot move towards its final position 40.

As the first and second connectors 12, 18 are mated, the primary latch 28 of the primary locking lever 20 contacts the sloped front end 54 of the primary striker 48. The primary locking lever 20 pivots as it is deflected by the primary latch 28 riding up in the sloped front end 54 of the primary striker 48 and the top striker surface 56 of the primary striker 48. As the first connector 12 and second connector 18 are further mated, the primary latch 28 clears the top striker surface 56 of the primary striker 48 and the primary locking lever 20 pivots back to its original orientation, engaging the primary latch 28 with the locking rear end 52 of the primary striker 48, thus locking the first connector 12 to the secondary connector as shown in FIG. 7.

As the primary latch 28 slides over the primary striker 48, the CPA lever 44 is deflected out of the slit 26 as the secondary striker 30 also rides up the sloped front end 54 of the primary striker 48. When the first connector 12 is fully mated with the second connector 18, the secondary latch 46 is out of the slit 26 and resting atop a top latch surface 58 of the primary latch 28. Since the primary latch 28 is now engaged with the primary striker 48 and, in its original orientation, the primary latch 28 is no longer blocking the secondary latch 46 and the CPA device 36 may be moved forward from the initial position 38 to the final position 40.

The CPA lever 44 includes a lateral lever flange 60 that extends laterally from each side of the CPA lever 44. This lever flange 60 is configured so that the CPA lever 44 can only be deflected from the slit 26 in one direction, in this example, upward out of the slit 26 so that the secondary latch 46 is no longer blocked by the primary latch 28. The lever flange 60 is configured to contact the pair of beams 24, so that the CPA lever 44 is prevented from being deflected downward out of the slit 26. If the CPA lever 44 were deflected downward out of the slit 26, the secondary latch 46 could "submarine" or move forward of the primary latch 28 before the primary latch 28 is engaged with the secondary latch 46 and allow the CPA device 36 to be moved from the initial position 38 before the first and second connectors 12, 18 are fully mated.

As the CPA device 36 moves forward from the initial position 38 to the final position 40, the secondary latch 46 rides over the primary striker 48 and the primary latch 28 until it clears the primary latch 28 and deflects back to its original orientation, thus engaging the secondary latch 46.

The primary locking lever 20 further comprises two lateral blocking flanges each extending on a respective side, from the primary locking lever 20. The mobile base 42 of the CPA device 36 further comprises two lateral guiding flanges on each side. Each lateral guiding flange is slideably mounted in a respective lateral guiding groove provided in the first connector 12, so as to guide the CPA device 36 form the initial position 38 to the final position 40.

The lateral blocking flanges are located in front of the lateral guiding grooves in their continuity, so that, when the CPA device 36 moves form the initial position 38 to the final position 40, the lateral guiding flanges extend in part ahead from the lateral guiding grooves and cover the lateral blocking flanges of the primary locking lever 20 ahead of the pivot point corresponding to the pivot lug. In the final position 40, the lateral guiding flanges of the CPA device 36 are blocked upwardly by the wall 62 of the second connector 18. Consequently, the primary locking lever 20 can no longer pivot if the release button 34 of the lifting lever 32 is actuated, thereby preventing the primary latch 28 and primary striker 48 from disengaging which would result in an unintentional unmating of the first and second connectors 12, 18.

In an alternative embodiment, the CPA lever 44 has a higher stiffness than the pair of beams 24 of the primary locking lever 20. If the release button 34 of the lifting lever 32 is actuated, the pair of beams 24 will bend while the CPA lever 44 maintains engagement of the secondary latch 46 with the secondary striker 30 and thereby maintains engagement of the primary latch 28 with the primary striker 48, thus preventing the primary latch 28 and primary striker 48 from disengaging which would result in an unintentional unmating of the first and second connectors 12, 18. According to this embodiment, a wall of one of the connectors 12, 18 does not block vertical movement of the CPA device 36 when the CPA device 36 is in the final position 40.

The CPA device 36 is prevented from going back unintentionally from the final position 40 to the initial position 38, by the secondary latch 46 of the CPA lever 44 being hook-shaped and stopped by the secondary striker 30.

In the above-described embodiments, the CPA device 36 is manually movable from its initial position 38 to its final position 40 in the same direction as the mating direction, which is particularly suitable from the ergonomic standpoint.

Accordingly a connector system having a connector position assurance device 36. The CPA lever 44 includes a lateral lever flange 60 that is configured to ensure that the CPA lever 44 can only be deflecting in a desired direction as the first and second connectors 12, 18 are mated so as to prevent the CPA lever 44 from going under or "submarining" the primary latch 28, thus preventing the CPA device 36 from being moved from the initial position 38 to the final position 40 before the first and second connectors 12, 18 are fully mated.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector assembly, comprising:

a first connector configured to mate with a second connector along a mating axis;

a primary locking lever pivotably mounted to the first connector;

a beam defined by the primary locking lever and extending along the mating axis;

a primary latch mounted to the beam, wherein the primary latch further defines a secondary striker; and a connector position assurance (CPA) device movable from an initial position to a final position only when the first connector and the second connector are mated, said CPA device having, a mobile base slideably mounted to the first connector, and a CPA lever mounted to the mobile base defining a secondary latch, wherein the secondary latch engages said primary latch to inhibit movement of the CPA device from the initial position to the final position until after the first connector and the second connector are mated, said CPA lever defining a lateral flange configured to engage said beam, thereby maintaining engagement of the primary latch with the secondary latch until the first connector and the second connector are mated, wherein the second connector includes a primary striker configured to engage the primary latch so as to lock the first connector and the second connector together when the first connector and the second connector are mated, and wherein the secondary latch of the CPA device is configured to engage the secondary striker when the CPA device is in the final position so as to prevent disengagement of the primary latch from the primary striker.

2. The connector assembly of claim 1, wherein the primary locking lever has a pair of beams extending from the primary latch along the mating axis and generally parallel to one another, wherein the pair of beams defines a slit there between and, wherein the CPA lever is at least partially disposed within said slit.

3. The connector assembly of claim 2, wherein the lateral flange extends laterally on each side of the CPA lever and is configured to engage said pair of beams, thereby maintaining engagement of the primary latch with the secondary latch until the first connector and the second connector are mated.

4. The connector assembly of claim 3, wherein the lateral flange is configured to engage the pair of beams, thereby maintaining engagement of the primary latch with the secondary latch until after the first connector and the second connector are mated.

5. The connector assembly of claim 2, wherein the lateral flange is configured to engage the pair of beams, thereby inhibiting a submarining of the CPA lever under the primary latch before the primary latch is engaged with and locked to the primary striker.

6. The connector assembly of claim 2, wherein the lateral flange is configured to engage the pair of beams, thereby inhibiting a submarining of the CPA lever under the primary latch until the first connector and the second connector are mated.

7. The connector assembly of claim 1, wherein the lateral flange is configured to inhibit movement of the CPA lever forward of the primary latch before the primary latch is engaged with and locked to the primary striker.

8. The connector assembly of claim 1, wherein, vertical movement of the secondary latch is inhibited by a wall of the first or second electrical connector when the CPA device is in the final position, thereby inhibiting release of the primary latch from the primary striker.

9. The connector assembly of claim 1, wherein the CPA lever is more rigid than the primary locking lever, so as to be able to inhibit release of the primary latch from the primary striker without the CPA lever interfacing a wall of the first or the second connector.

10. A connector assembly, comprising:

a first connector and a second connector configured to mate with each other along a mating direction, wherein the first connector has a primary latch and a secondary striker and the second connector has a primary striker configured to engage the primary latch so as to lock the first connector and the second connector when they are mated, wherein the first connector includes a CPA device movable from an initial position to a final position only when the first connector and the second connector are mated, wherein the CPA device includes a mobile base mounted on a housing of the first connector, a CPA lever fixed to the mobile base, and a secondary latch configured to engage, in the final position of the CPA device, the secondary striker so as to prevent disengagement of the primary latch and the primary striker, characterized in that the connector assembly further includes a lateral flange defined by the CPA lever configured to allow a movement of the CPA device from the initial position to the final position only when the first connector and the second connector are mated.

11. The connector assembly of claim 10, wherein the primary latch is mounted to a pair of beams extending along a mating axis generally parallel to one another and defining a slit there between and wherein the CPA lever is at least partially disposed within said slit.

12. The connector assembly of claim 11, wherein the lateral flange extends laterally on each side of the CPA lever.

13. The connector assembly of claim 12, wherein the lateral flange is configured to engage the pair of beams, thereby inhibiting a submarining of the CPA lever under the primary latch before the primary latch is engaged with and locked to the primary striker.

14. The connector assembly of claim 12, wherein the lateral flange is configured to engage the pair of beams, thereby inhibiting a submarining of the CPA lever under the primary latch until the first connector and the second connector are mated.

15. The connector assembly of claim 10, wherein, vertical movement of the CPA lever is inhibited by a wall of the first or the second connector when the CPA device is in the final position, thereby inhibiting release of the primary latch from the primary striker.

16. The connector assembly of claim 10, wherein the secondary latch is more rigid than the primary latch, so as to be able to inhibit release of the primary latch from the primary striker without the CPA lever interfacing a wall of the first or the second connector.

17. The connector assembly of claim 10, wherein the lateral flange is configured to inhibit movement of the CPA lever forward of the primary latch before the primary latch is engaged with and locked to the primary striker.

18. A connector assembly, comprising:

a first connector configured to mate with a second connector along a mating axis wherein the second connector includes a primary striker;

a primary locking lever pivotably mounted to the first connector;

a beam defined by the primary locking lever and extending along the mating axis;

a primary latch configured to engage the primary striker, wherein the primary latch further defines a secondary striker; and a CPA device movable from an initial position to a final position, said CPA device having, a mobile base slideably mounted to the first connector, and a CPA lever mounted to the mobile base defining a secondary latch, wherein said primary latch is in a position to block movement of the CPA device from the initial position to the final position until the first connector and the second connector are fully mated and the primary latch is engaged with the primary striker and wherein said CPA lever defines a lateral flange configured to contact said beam, thereby inhibiting movement of the secondary latch under the primary latch that would allow movement of the CPA device from the initial position prior to the full mating of the first connector and the second connector.

19. The connector assembly of claim 18, wherein the secondary latch of the CPA device is configured to engage the secondary striker when the CPA device is in the final position so as to prevent disengagement of the primary latch from the primary striker.

* * * * *